United States Patent [19]

Elliot

[11] 4,141,219

[45] Feb. 27, 1979

[54] METHOD AND TURBINE FOR EXTRACTING KINETIC ENERGY FROM A STREAM OF TWO-PHASE FLUID

[76] Inventors: Robert A. Frosch, Administrator of the National Aeronautics and Space Administration, with respect to the invention of David G. Elliott, La Canada, Calif.

[21] Appl. No.: 847,278

[22] Filed: Oct. 31, 1977

[51] Int. Cl.[2] ..... F01K 25/04; F01K 21/00

[52] U.S. Cl. ..... 60/645; 60/649; 415/1; 415/143

[58] Field of Search ..... 415/143, 1; 60/649, 60/673, 674, 643, 645, 670, 721

[56] References Cited

U.S. PATENT DOCUMENTS 3,358,451 12/1967 Feldman ..... 60/671 X 3,972,195 8/1976 Hays ..... 60/649 X 4,027,993 6/1977 Wolff ..... 415/1

*Primary Examiner*—Allen M. Ostrager

*Attorney, Agent, or Firm*—Monte F. Mott; John R. Manning; Wilfred Grifka

[57] ABSTRACT

A turbine including a plurality of nozzles for delivering streams of a two-phase fluid along linear paths, a phase separator for responsively separating the vapor and liquid characterized by concentrically related annuli supported for rotation within the paths and having endless channels for confining the liquid under the influence of centrifugal forces, a vapor turbine fan for extracting kinetic energy from the vapor, and a liquid turbine blade for extracting kinetic energy from the liquid whereby angular momentum of both the liquid phase and the vapor phase of the fluid is converted to torque.

20 Claims, 7 Drawing Figures

METHOD AND TURBINE FOR EXTRACTING KINETIC ENERGY FROM A STREAM OF TWO-PHASE FLUID

ORIGIN OF THE INVENTION

The invention described herein was made in the performance of work under a NASA contract and is subject to the provisions of Section 305 of the National Aeronautics and Space Act of 1958, Public law 85-568 (72 Stat. 435; 42 USC 2457).

BACKGROUND OF THE INVENTION

1. Field of the Invention

The invention generally relates to a method and device for extracting kinetic energy from a stream of fluid containing a mixture of liquid and vapor, herein referred to as a two-phase fluid, and more particularly to an improved method and turbine particularly suited for use in separately extracting kinetic energy from each phase of a two-phase fluid which tends to characterize geothermal sources of power.

2. Description of the Prior Art

The prior art is, of course, replete with turbines adapted for use in extracting kinetic energy from streams of fluids such as water in its liquid phase, and/or in its vapor phase.

As can readily be appreciated by those familiar with the design and operation of turbines, such as stream turbines and the like, the use of two-phase fluids is severely impaired in instances where the fluid is delivered to a turbine in both its liquid and vapor phase, since the velocity of the vapor tends to exceed the velocity of the liquid resulting in reduced efficiency. Consequently, various attempts have been made to separate the liquid phase from the vapor phase of a fluid, prior to the delivery of the fluid to a turbine, employing systems which permit the vapor phase, or steam, to drive a turbine while the liquid phase of the fluid is discharged as waste.

With the advent of an increased interest in the development of sources of geothermal power, increased attention is being given to the development of turbines capable of utilizing two-phase fluids such as mixtures of vapor and liquid. In order to achieve a maximum output from such a turbine, it is apparent that kinetic energy must be extracted from both the liquid phase and the vapor phase of the given fluid. Finally, it has long been recognized that small, closed-cycle engines using steam can be operated at lower, more desirable shaft speeds, and achieve certain other advantages upon a mixing of an inert liquid with steam provided as the primary source of energy.

Conventional turbines, such as impulse turbines, are not totally suitable for use in extracting energy for two-phase fluids because of the inherent tendency of the liquid phase to separate from the vapor phase and follow a path of its own. Attempts have been made to solve the problems which attend the existence of separate flow paths for liquid and vapor phases of a fluid delivered to a turbine. These attempts have resulted in systems such as the system disclosed in U.S. Pat. No. 3,879,949. However, turbines of this type tend to be complex, excessively bulky and costly, particularly where such a turbine is designed to be employed for extracting kinetic energy from a flow of a two-phase fluid derived from a geothermal source.

It is, therefore, the general purpose of the invention to provide a simple, economic and practical turbine particularly suited for use in extracting kinetic energy from a stream of two-phase fluids, such as a stream of fluid containing both steam and water, which overcomes the aforementioned difficulties and disadvantages without sacrificing the recognized advantages previously attributable to turbines in extracting kinetic energy from streams of fluid.

OBJECTS AND SUMMARY OF THE INVENTION

It is an object to provide an improved method for extracting kinetic energy from a stream of a two-phase fluid.

It is another object to provide an improved turbine for use in extracting kinetic energy from a stream of a two-phase fluid.

It is another object to provide an improved method for extracting kinetic energy from a stream of a two-phase fluid wherein the phases are separated and the kinetic energy is separately extracted from both the vapor and the liquid.

It is another object to provide a method wherein the phases of a two-phase fluid are separated, the kinetic energy is separately extracted from the separate phases and thereafter utilized in driving a common output shaft for thus enhancing the efficiency of the turbine.

It is another object to provide a method for extracting kinetic energy from a two-phase fluid wherein the liquid phase of the fluid is caused to traverse an annular path while the vapor phase thereof is caused to traverse a path substantially axially related to the annular path of the liquid phase, whereby a simultaneous extraction of the kinetic energy is facilitated.

It is another object to provide a turbine for a two-phase fluid which includes a plurality of concentrically related annuli supported within the path of a stream of a two-phase fluid for separating the liquid phase from the vapor phase of the fluid of the stream and thereafter directing the thus separated phases of the fluid through mutually independent turbine blades for simultaneously extracting kinetic energy from both phases of the fluid.

It is another object to provide a turbine particularly suited for use in extracting kinetic energy from a stream of a two-phase fluid having a capability for directing the liquid phase along an annular path and the vapor phase of the fluid along a path substantially axially related to the annular path for the liquid phase of the fluid, whereby higher flow rates are attained with an attendant increase in the overall efficiency of the turbine.

Another object is to provide an improved turbine which is particularly useful in connection with the separation of water and vapor derived from a geothermal well, although not necessarily restricted in use thereto, since the turbine may be employed for similar purposes when installed in systems utilized in the extraction of kinetic energy from two-phase fluids derived from sources other than geothermal wells, such as where a mixture of steam and an inert liquid is employed as a source of energy.

These and other objects and advantages are achieved through the use of a turbine including a housing, a plurality of nozzles for delivering a multiplicity of streams of the two-phase fluid to the housing along the plurality of linear, angularly related paths, a phase separator disposed within the housing for effecting a responsive separation of the liquid phase from the vapor phase of the two phase fluid, characterized by a plurality of concentrically related annuli supported for simultaneous rotation, each having an endless channel defined therein for collecting and confining liquid within an annular pool as centrifugal forces are applied to the annuli in response to momentum-induced rotation of the annuli, a vapor turbine fan for extracting kinetic energy from the vapor phase of the fluid and a liquid turbine blade for extracting kinetic energy from the liquid phase and an output shaft commonly connected to the fan and blade whereby the energy thus derived is exerted about a common output shaft, as will become more readily apparent by reference to the following description and claims in light of the accompanying drawings.

DESCRIPTION OF THE PREFERRED EMBODIMENT

Figure 1:
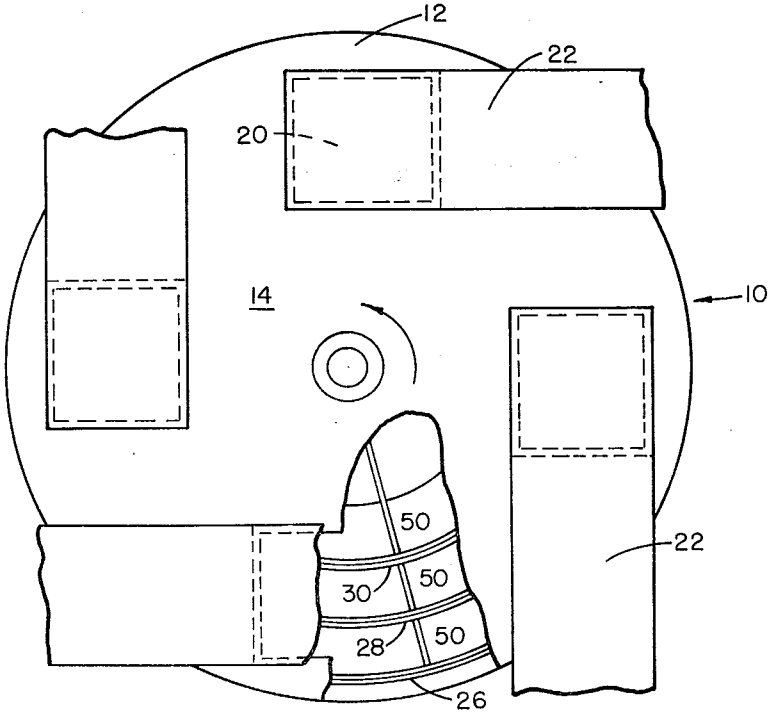
FIG. 1 is a fragmented, front elevational view of a turbine which embodies the principles of the instant invention.

Referring now to the drawings with more particularity, wherein like reference characters designate like or corresponding parts throughout the several views, there is shown in FIG. 1 a turbine, generally designated 10, which embodies the principles of the instant invention. The turbine is particularly useful in extracting kinetic energy from a stream consisting of a mixture of two-phases of a fluid, such as water and steam, as may be found in a geothermal power source. However, it is to be understood that the turbine 10 has utility separate and apart from such systems.

As shown in the drawings, the turbine 10 includes a suitable housing 12 formed of a pair of oppositely related end plates 14 and 16 and a peripheral wall 18 of a generally circular configuration. As a practical matter, the housing 12 is fabricated from suitable materials, such as sheet metal and the like, employing fabrication techniques well within the skills of the art.

Figure 2:
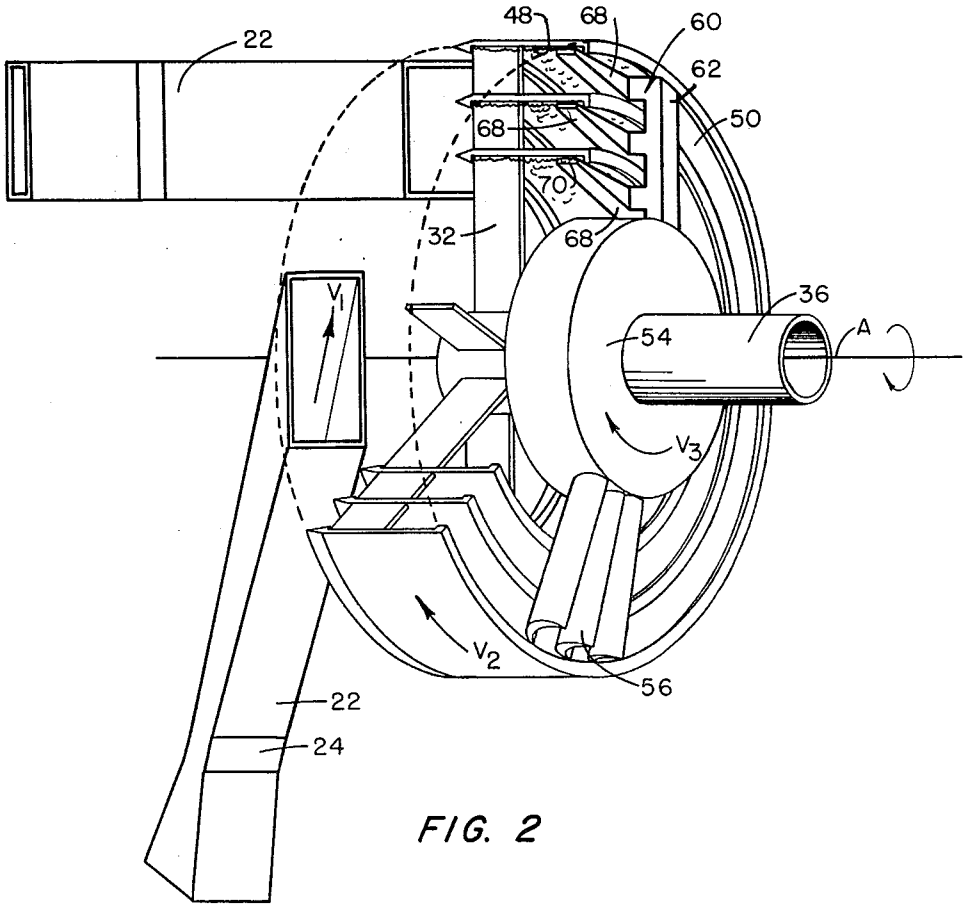
FIG. 2 is a fragmented perspective view of the turbine shown in FIG. 1, rotated through more than 90° but less than 180° from its orientation in FIG. 1, illustrating a preferred relationship of an array of vapor fan blades and a liquid blade turbine.

Defined within the end plate 14, is a plurality of angularly spaced delivery orifices 20. Through these orifices are delivered streams of a selected two-phase fluid. As illustrated in the drawings, four orifices are uniformly arranged within quadrants of the end plate 14. Connected in communication with each of the orifices is a delivery conduit 22 having provided therein a throat 24, FIG. 2, the purpose of which is to maximize the velocity of the two-phase fluid prior to its delivery to the turbine through the orifice with which it communicates. It is to be noted that the axes of the conduits project in a common angular direction, relative to the periphery of the turbine, and are inclined with respect to the plane of the turbine so that each stream is characterized by a momentum having both peripheral and axial components. Consequently, it should be apparent that a two-phase fluid delivered to the turbine 10 is delivered along paths projecting through the orifices 20 at a common velocity, designated $V_1$, FIG. 2, determined in part by the configuration of the conduit and that the direction of the components of the momentum of the fluid will vary, depending upon the angular relationship of the axes of the conduits to the plane of the end plate 14.

Within the turbine 10 there is supported for rotation a separator, generally designated 25. The separator 25 comprises a plurality of concentrically related annuli 26, 28 and 30, FIG. 1. The annuli 26 through 30 are coupled together employing a plurality of uniformly spaced radial supports 32. These supports are affixed at their base ends to a concentrically related bearing sleeve 34. As a practical matter, the radial supports 32 are formed from a suitable lightweight material employing known fabrication techniques. As a practical matter, where so desired, the radial supports are welded at their base ends to the bearing sleeve 34 as well as to each of the annuli 26 through 30. In any event, it is to be understood that the radial supports 32 are uniformly spaced about the bearing sleeve 34 and support the annuli 26 through 30 in a concentric relationship with the sleeve 34 which, in turn, supports the annuli for angular displacement about an axis of rotation coincident with an axis of symmetry passing through the end plates 14 and 16.

Figure 4:
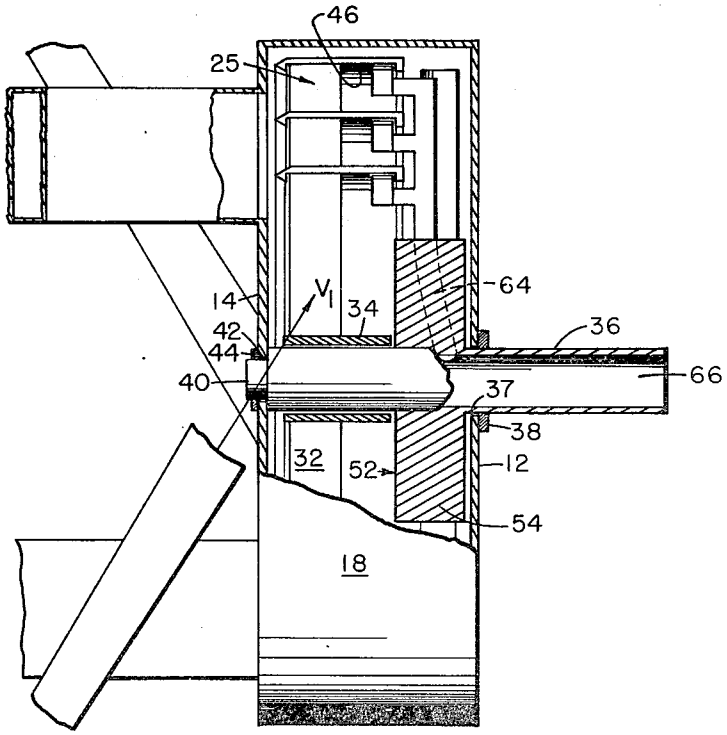
FIG. 4 is a fragmented, partially sectioned end elevational view of the turbine.

As a practical matter, the bearing sleeve 34 is seated on a tubular shaft 36, FIG. 4, which functions as an output shaft for the turbine 10. The shaft 36 projects through a suitably formed orifice 37, provided in the end plate 12, and is there supported by an annular bearing 38 coaxially aligned with the orifice and affixed to the end plate. One end of the shaft 36 is supported by a stub axle 40 projected through an orifice 42 formed in the end plate 14 and is there supported by an annular bearing 44, welded or otherwise affixed to the end plate 14 in coaxial alignment with the orifice 42.

Consequently, it should now be appreciated that the bearing sleeve 34 and the tubular shaft 36 are each supported for mutually independent rotation about a common axis and that separate rates of rotation may be imparted simultaneously thereto. It also is important to note that each annulus supported by the bearing sleeve is of a substantially U-shaped, cross sectional configuration, with each having defined along its innermost peripheral surface an endless flat-bottom channel designated 46. The purpose of the channel 46 is to capture and confine the liquid phase of a two-phase fluid delivered to the housing 12 through the orifices 20 which accommodate passage of the vapor phase. In order to confine the liquid phase of the fluid within the channels 46, it is necessary that rotation be imparted to the separators 25 whereby centrifugal forces are caused to act on the liquid for thus causing the liquid to be confined against the bottom of the channels 46.

Rotary motion is imparted to the separator 25 in response to an impingement thereagainst of the two-phase fluid, as it is delivered through the delivery orifices 20. It will be appreciated that the linear paths, along which the streams of the two-phase liquid are delivered, project into the housing 12, in a generally clockwise circumferential direction, as viewed in FIGS. 2 and 3, at a common velocity designated $V_1$, FIGS. 2 and 4. Furthermore, the paths along which the two-phase fluid enters the housing 12 are angularly related to the plane of the end plate 14 so that the two-phase fluid, in effect, enters the housing with a component of momentum paralleling the axis of rotation of the separator 25 as well as a component of momentum transversely related to the axis of rotation for the separator 25. Because of the inertia of the liquid phase of the two-phase fluid the liquid inherently tends to follow substantially straight-line paths upon entry into the housing and is thus directed to impinge against the surfaces defining the channels 46 for the annuli 26 through 30 of the separator 25. This component of momentum serves to impart an angular velocity to the separator 25, whereupon the separator achieves angular velocity, designated $V_2$, substantially equal to the velocity designated $V_1$. Of course, as the liquid phase of the fluid impinges against the separator 25, and rotation is responsively imparted to the separator 25, an annular pool 48 is formed within each of the channels 46 and assumes a velocity, averaged over the annuli 26 through 30, approximately equal to the velocity $V_1$. Of course, the actual velocities of the pools thus formed are slightly less than velocity $V_1$ due to impact and windage losses.

Figure 6:
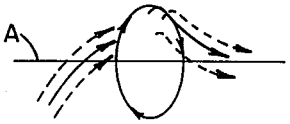
FIG. 6 is a flow diagram illustrating separate paths for the two-phase fluid through the turbine.

The vapor phase from which the liquid phase has been removed, as a consequence of the impingement of the liquid phase on the annuli 26 through 30 of the separator 25, proceeds along a path substantially paralleling the axis A, as indicated in FIG. 6. Hence, it will be appreciated that the path followed by the vapor phase through the separator 25 extends through radially spaced annular openings, designated 50, existing in communication with the channels 46. Since the streams of the two-phase fluid introduced through the orifices 20 have components extending circumferentially as well as axially, with respect to the separator 25, the vapor tends to retain a circumferential velocity as it passes through the openings 50. Hence, the path followed by the vapor is not a precise axial path.

Mounted on the shaft 36 in fixed relation therewith, there is a turbine fan generally designated 52. Through this fan extends the path of the vapor phase. As a practical matter, the turbine fan 52 is of a well known design and includes an annular hub 54 rigidly affixed to the shaft 36, whereby the shaft 36 is caused to rotate simultaneously with the hub 54. The turbine fan 52, as shown, includes a plurality of radially projected turbine blades 56 rigidly affixed to the hub 54. The blades 56 are connected with the hub in a manner well understood by those familiar with the design, construction and operation of steam turbines. It is important to note that the turbine fan 52 includes as many turbine blades 56 as are required, spaced apart a distance sufficient to achieve a desired conversion of the momentum of the vapor phase to torque in a manner consistent with the design and operation of steam turbines.

Figure 3:
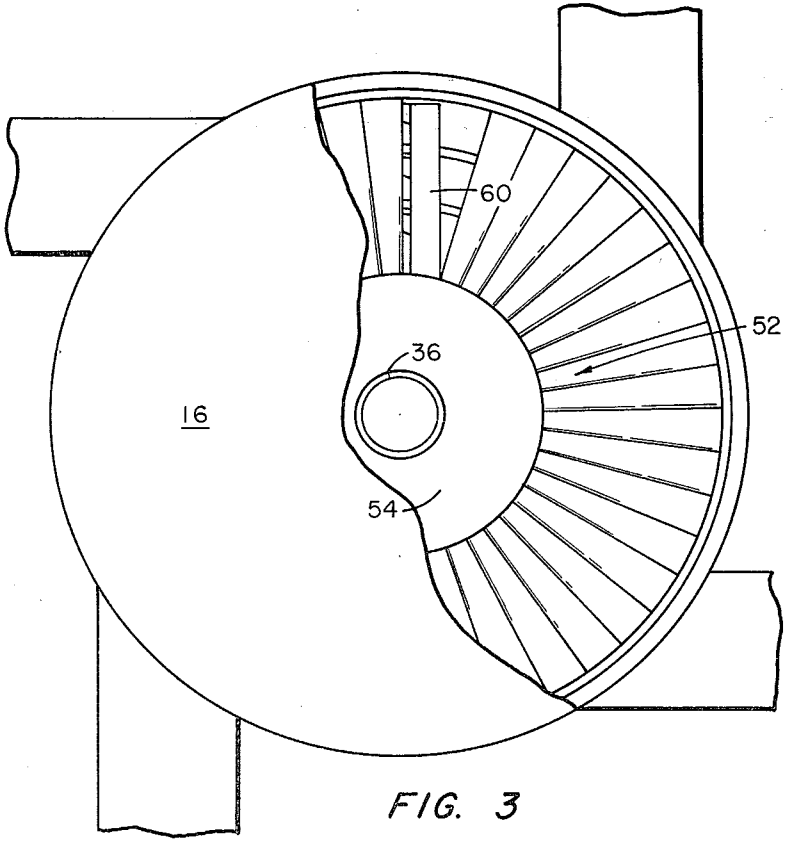
FIG. 3 is a fragmented rear elevational view of the turbine.
Figure 7:
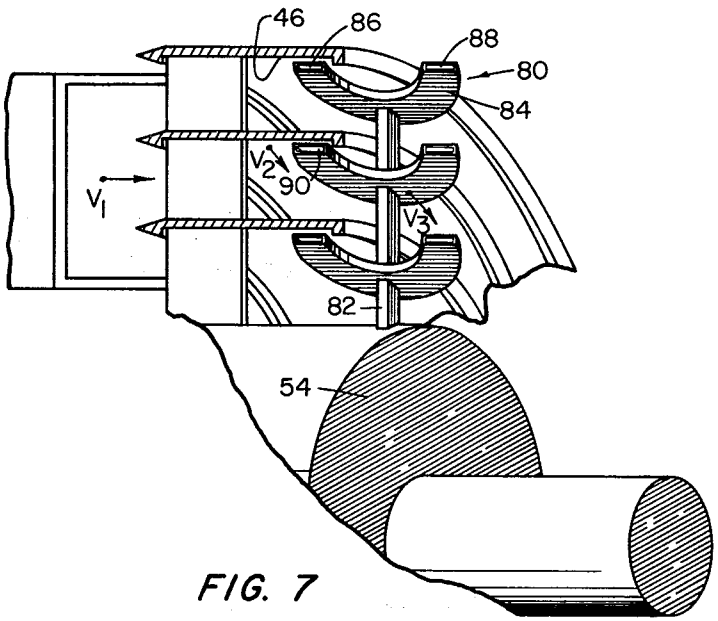
FIG. 7 is a fragmented, partially sectioned modified form of the turbine blade shown in FIG. 5.

Also mounted on the hub 54 is at least one liquid turbine blade 60. This blade, as shown, includes a tubular body 62 extended in substantial parallelism with respect to the diameter of the fan 52, as shown in FIG. 3. The tubular body 62 has defined therein a collector conduit 64 the axis of which, in effect, lies along a cord for the hub 54.

Figure 5:
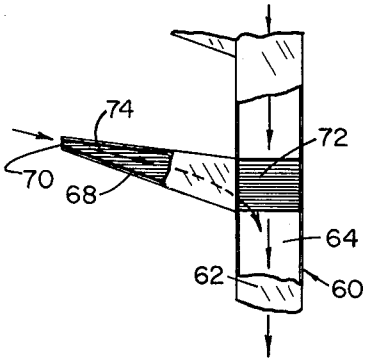
FIG. 5 is a fragmented, partially sectioned view of a portion of the liquid blade employed in the turbine.

The terminal portion of the conduit 64, of the liquid turbine blade 60, as best illustrated in FIG. 5, is extended substantially radially through the hub 54 to communicate with an interior passageway, designated 66, provided for the tubular shaft 36, FIG. 4. Mounted on the tubular body 62, at uniformly spaced locations, is a plurality of hollow bodies connected in communication with the conduit 62 of the turbine blade for thus forming, in effect, a flume 68, the purpose of which is to convey streams of the liquid phase of the fluid, aforementioned, from the pools formed in the channels 96 to the liquid turbine blade 60.

It is important here to appreciate that each of the flumes 68, FIG. 5, includes an orifice 70 which functions as an inlet, an orifice 72 which functions as an outlet, and a central chamber 74 extended between the orifices 70 and 72. The purpose of the chamber 74 is to decelerate the liquid phase as it enters the flume via the inlet 70 to provide pressure for overcoming the centrifugal pressure of radiant development within the radial inflow passageway 64. The centrifugal pressures, of course, are developed as the vapor phase is passed between the turbine blades 56 to impart to the turbine fan 52 an angular velocity $V_3$, FIG. 2. However, it should also be noted that the tubular shaft 36 also functions as an output shaft for the turbine 10. Therefore, the shaft 36 provides an output torque, the maximum value of which is achieved, in operation, when the angular displacement of the shaft 36 is zero under a given load. Hence, because of the loading of the shaft 36, the shaft, as well as the hub 54 connected therewith, rotates at a velocity much lower than the velocity of the separator 25.

In practice, the maximum-efficient turbine speed for the turbine 10 is achieved when the velocity $V_3$ equals $V_{\frac{1}{2}}$. It should now be apparent, that the pools 48 of the liquid phase confined within the channels 46 are characterized by an angular velocity substantially greater than the angular velocity of the liquid turbine blade 60 and that the flumes 68, in effect, perform a scooping function for capturing the liquid phase of the pools and thus the liquid phase is delivered to the turbine blade. Since the velocity of the liquid phase entering the flumes 68 is decreased in the chamber 74, the kinetic energy of the liquid phase is extracted as the momentum is converted to torque applied about the axis A of the shaft 36.

At this juncture, it is noted that in lieu of the liquid turbine blades 60, an impulse liquid turbine blade of the type shown in FIG. 9 is employed. The turbine blade of FIG. 9, designated 80, includes a rigidly affixed body 82 which is extended substantially radially from the hub 54. Affixed to the rigid body 82, at radially spaced locations therealong, there is a plurality of U-shaped conduits 84. Each of the conduits 84 includes an inlet orifice 86 communicating with a channel 46 adapted to be submersed in a pool 48 confined with a channel 46. Each of the conduits 84 also includes a discharge orifice 88 which communicates with the inlet 86 through a reversing channel 90. Consequently, it will be appreciated that as the liquid phase of the fluid is caused to enter the conduit 84, via the inlet orifices 86, its direction of flow is reversed within the reversing channel 90 so that it exits the conduit 84, at the discharge orifice 88 at substantially zero absolute velocity, particularly where the maximum-efficient turbine speed is $V_{\frac{1}{2}}$, aforementioned.

OPERATION

It is believed that in view of the foregoing description, the operation of the device will readily be understood, however, it will be reviewed briefly at this point.

With the turbine 10 assembled in the manner hereinbefore described, it is prepared for operation simply by coupling the conduits 22 with a source of two-phase fluid maintained under pressure sufficient to impart a linear velocity to the fluid. Such a source is typified by a geothermal well.

As the two-phase fluid exits the throats 24 of the conduits 22 it is accelerated to its maximum velocity so that upon entering the housing 12, via the delivery orifices 20, the two-phase fluid is characterized by a velocity, designated $V_1$. As the two-phase fluid exits the delivery orifices 20 it is directed along paths extended in substantially circumferential directions with a component of velocity extended substantially parallel the axis of rotation for the separator 25.

However, because of the inertia of the liquid phase it is caused to progress along a substantially linear path to impinge against the inner surfaces of the annuli 26 through 30 of the separator 25. As a consequence of the momentum of the liquid phase, a second velocity, designated $V_2$, approximating the velocity $V_1$ is imparted to the annuli of the separator 25. Because of the rotation thus imparted to the separator 25, the liquid phase of the fluid is captured and retained within the channel 46 under the influence of centrifugal forces acting thereon. However, the vapor phase of the fluid is permitted progress along a path extending through the spaces 50 and then between the blades 56 of the turbine fan 52 for thus imparting angular displacement to the shaft 36 in a manner consistent with the operation of steam turbines. Of course, as a load is applied to the shaft 36, the angular velocity of the shaft, the hub 54 and the turbine blades 56 and 60 is decreased. Because of the angular velocity of the annuli 26 through 30 of the separator 25, the velocity of the pools 48 of the liquid phase of the fluid confined within the channels 46 remains uneffected, since, it will be recalled, the separator 25 is permitted to rotate freely with respect to the shaft 36. Hence the pools 48 are characterized by velocities greater than the velocities of the flumes 68. Thus the momentum of the liquid phase of the pools 48 causes the liquid phase to be forced through the inlets 70 of the flumes.

As the liquid phase enters the inlets 70 of the flumes 68 it tends to decelerate within the chambers 74 as it acts in opposition to the centrifugal pressure gradiant of the radial-inflow tubular passageway 64. This pressure gradiant ultimately is overcome by the pressure of the liquid phase entering the flume. As the momentum of the liquid phase is dissipated a transfer of kinetic energy to the turbine 10 is effected whereby the momentum of the liquid phase is converted to torque applied about the output shaft 36.

In instances where the radial-inflow liquid turbine blades are replaced by the impulse liquid turbine blades 80, the liquid phase entering the inlet orifices 86 is discharged, via the discharge orifices 88, after the direction of flow thereof has been reversed within the reversing channels 90 so that the liquid phase is discharged with a zero velocity. Thus the angular momentum of the liquid phase of the fluid is converted to torque applied about the axis of the output shaft 36.

In view of the foregoing, it should be apparent that the turbine 10 is particularly suited for extracting energy from two-phase fluids, such as steam and water, which characterize fluids derived from a geothermal well be employed as a source of power.

Although the invention has been herein shown and described in what is conceived to be the most practical and preferred embodiment, it is recognized that departures may be made therefrom within the scope of the invention, which is not to be limited to the illustrative details disclosed.

What I claim is:

1. In a method for extracting kinetic energy from a stream of a two-phase fluid, the steps comprising:

A. imparting linear velocity to a stream of a two-phase fluid; and

B. separating the liquid phase from the vapor phase of the fluid while simultaneously redirecting the flow of the liquid phase along an annular path for imparting thereto an angular velocity, and redirecting the flow of the vapor phase along a path substantially axially related to the annular path.

2. The method of claim 1 further comprising the steps of simultaneously converting the momentum of the separated liquid phase and vapor phase to torque.

3. The method of claim 1 wherein the step of separating the liquid phase from the vapor phase includes the step of collecting the liquid phase in an annular pool having an angular velocity substantially equal to the linear velocity of the stream.

4. The method of claim 3 wherein the step of converting the momentum of the liquid phase and vapor phase to torque includes the step of passing the vapor phase axially through an annular array of steam turbine blades mounted on a common hub and the step of passing the liquid phase through a liquid turbine blade mounted on the hub.

5. The method of claim 4 wherein the step of passing the liquid phase through a liquid turbine blade includes the step of forcing the liquid to flow radially inwardly with respect to a liquid turbine blade.

6. The method of claim 4 wherein the step of passing the liquid phase through a liquid turbine blade includes the step of forcing the liquid to flow along a U-shaped path having a discharge segment reversely oriented to an intake segment.

7. The method of claim 2 wherein the step of converting the momentum of the liquid phase and vapor phase to torque includes the step of converting the momentum of both the liquid phase and vapor phase to torque exerted about a common output shaft.

8. In an improved turbine for a two-phase fluid, the improvement comprising:

A. means adapted to receive a stream of fluid flowing along a linear path consisting of a liquid phase and a vapor phase; and B. means for separating the liquid phase from the vapor phase of said fluid including means for redirecting the liquid phase to an annular path and the vapor phase to a path axially related to the annular path.

9. The improvement of claim 8 further comprising means for converting the momentum of said liquid phase and the momentum of said vapor phase simultaneously to torque subsequent to the separation thereof.

10. The turbine of claim 9 wherein the torque is exerted on a common output shaft.

11. The turbine of claim 9 wherein the means for converting the momentum of the liquid phase and the momentum of the vapor phase to torque includes an annular array of steam turbine blades mounted on a common hub, and a liquid turbine blade affixed to and extended substantially radially from the hub.

12. The turbine of claim 11 wherein the liquid turbine blade includes an integrally related flume having an inlet communicating with the liquid phase redirected to an annular path, and an output communicating with a passageway extended axially through the liquid turbine blade.

13. The turbine of claim 12 wherein the turbine blade includes an integrally related flume of a U-shaped configuration having an inlet communicating with the liquid phase redirected to an annular path and an outlet for discharging the liquid phase at a substantially zero absolute velocity.

14. An improved turbine for a fluid consisting of a mixture of liquid and vapor comprising:

A. a turbine housing;

B. means for delivering to said housing a stream of fluid consisting of a liquid and a vapor;

C. means for separating the liquid and the vapor; and

D. means for extracting kinetic energy from both the liquid and the vapor, subsequent to the separation thereof.

15. The turbine of claim 14 wherein said means for separating the liquid and the vapor includes at least one annulus supported for rotation in the path of the stream having defined therein an endless channel for capturing and confining the liquid therein for thus forming within the channel a pool of liquid having an angular velocity, and for redirecting the vapor along a path axially related to the annulus.

16. The turbine of claim 15 wherein the means for extracting kinetic energy from the vapor includes a rotatable hub coaxially aligned with the annulus, and means for transferring kinetic energy from the vapor to the hub including a turbine fan mounted on the hub in the path of the vapor for connecting the momentum of the vapor to torque exerted on said hub, and the means for extracting kinetic energy from the liquid includes at least one liquid turbine blade mounted on the hub having a flume communicating with the pool of liquid for transferring the liquid from the pool to the liquid turbine blade for converting the momentum of the liquid to torque exerted on said hub, whereby the hub is rotated at a first velocity.

17. The turbine of claim 16 wherein said liquid turbine blade comprises a radial inflow turbine blade characterized by a tubular body extended substantially radially from said hub and rotation is imparted to said annulus at a second velocity greater than the first velocity substantially in response to a transfer of momentum from the liquid of the stream of fluid to the annulus.

18. The turbine of claim 17 wherein said flume comprises a tubular body seated in said endless channel in transverse relation with the axis of rotation for said annulus and includes:

A. means defining within the flume an inlet facing the direction of rotation for said annulus for receiving the liquid from the channel;

B. means defining in the flume an outlet for discharging the received liquid to the liquid turbine blade; and C. means defining in the flume, between the inlet and outlet thereof, a decelerating chamber for providing pressure sufficient to overcome the centrifugal pressure gradiant developed in the tubular body as rotation.

19. The turbine of claim 16 wherein the liquid turbine blade includes a rigid member projected radially from said hub and said flume includes a tubular body of a substantially U-shaped configuration having a pair of legs arranged in substantial parallelism, and means defining at the terminal of one leg an inlet seated in said endless channel for receiving liquid from the pool, and means defining the other leg a discharge for expelling liquid therefrom.

20. An axial-flow separator turbine for extracting energy from a two-phase fluid, such as a mixture of steam and water, comprising:

A. a turbine housing;

B. a plurality of nozzles for delivering a plurality of streams of two-phase fluids to said housing along a plurality of linear paths angularly related to an axis of symmetry for said housing;

C. a tubular shaft extended axially through said housing and supported thereby for rotation about an axis of rotation coincident with an axis symmetry for the shaft;

D. a phase separator disposed within said housing in the paths of said streams adapted to receive said streams in impinging engagement for effecting a responsive separation of the liquid phase from the vapor phase of the fluid, said separator being characterized by a plurality of concentric annuli mounted on said shaft and supported thereby for simultaneous rotation, each annulus of the plurality being characterized by a U-shaped cross sectional configuration defining therein an endless channel disposed in the paths of said streams for collecting liquid from the impinging streams and confining the collected liquid as centrifugal forces are applied to the annuli as the linear momentum of the impinging liquid serves to impart angular momentum to the annuli;

E. a vapor turbine fan disposed within the housing in the path of the streams for extracting kinetic energy from the vapor phase including a hub integrally related with said shaft and an annular array of steam turbine blades extended radially from the hub and supported thereby for rotation imparted thereto in response to a transfer thereto of the momentum of said vapor phase;

F. a liquid turbine disposed within said housing for extracting kinetic energy from the liquid phase including at least one radial-inflow liquid turbine blade characterized by a tubular body communicating with said tubular shaft and mounted on said hub in a radially extended relationship therewith for receiving a stream of the liquid phase; and G. a liquid phase delivery system for delivering the liquid phase from said separator to said blade including a plurality of tubular bodies rigidly mounted on said liquid turbine blade in mutually spaced relation, each body of said plurality being seated in an endless channel and having an inlet facing the direction of rotation imparted to the annuli, and an outlet communicating with said liquid turbine blade for delivering thereto a stream of the liquid phase having an angular momentum imparted thereto in response imparted to the annuli.

* * * * *